United States Patent [19]

Atsushi

[11] Patent Number: 4,665,717

[45] Date of Patent: May 19, 1987

[54] LATCH NEEDLE FOR RASCHEL MACHINE

[75] Inventor: Kurokawa Atsushi, Mie, Japan

[73] Assignee: Nakagawa Seisakusho Co., Ltd., Anou, Japan

[21] Appl. No.: 833,844

[22] Filed: Feb. 26, 1986

[30] Foreign Application Priority Data

Feb. 27, 1985 [JP] Japan ..... 60-27593[U]

[51] Int. Cl.[4] ..... D04B 35/06

[52] U.S. Cl. ..... 66/122; 66/119; 66/208; 66/214

[58] Field of Search ..... 66/122, 123, 121, 120, 66/119, 114, 115, 208, 214, 87, 88

[56] References Cited

U.S. PATENT DOCUMENTS 975,466 11/1910 Scott ..... 66/123
1,681,512 8/1928 Beyer ..... 66/123
2,010,205 8/1935 Swinglehurst ..... 66/123
2,086,962 7/1937 Schmidt ..... 66/123
3,978,691 9/1973 Schmid ..... 66/208

FOREIGN PATENT DOCUMENTS 2144152 2/1985 United Kingdom ..... 66/115
896100 1/1982 U.S.S.R. ..... 66/208

*Primary Examiner*—Ronald Feldbaum
*Assistant Examiner*—Mary A. Ellis
*Attorney, Agent, or Firm*—Moonray Kojima

[57] ABSTRACT

A latch needle for a Raschel machine having a branch stem branched from a portion are side of the stem below the latch so as to extend downward substantially in parallel to the lateral side of the stem, and having a thickness greater than that of the stem.

7 Claims, 13 Drawing Figures

LATCH NEEDLE FOR RASCHEL MACHINE

FIELD OF THE INVENTION AND RELATED ART STATEMENT

The present invention relates to a latch needle for a Raschel machine.

It is a usual practice to form a needle block for a Raschel machine by arranging a plurality of latch needles, for example, ten to thirty needles, at regular intervals and fixing the lower end portions of stems of the latch needles in a block of a metal having a low melting point, such as lead, by casting the metal. Since the latch needles are slender and small rods, closely arranging a plurality of such latch needles at regular intervals in the same situation with the hooks thereof in alignment with each other requires considerably skilled work. Accordingly, it has been difficult to improve the efficiency of the machine work for forming the needle block, not to mention the manual work for forming the same.

Since the conventional latch needles are slender and small rods, closely arranging a plurality of such latch needles at regular intervals in the same situation with the hooks thereof in alignment with each other is very difficult even by means of a machine or tools, not to mention through manual work. It is also possible that the regular arrangement of the latch needles is disordered by the flow of a metal having a low melting point in pouring the molten metal into a mold in which the stems of the latch needles arranged at regular intervals are inserted and that the latch needles each having a slender and thin stem are liable to be bent and, at the worst, to be broken on the needle block when a large and sudden force is applied to the latch needles accidentally during knitting operation due to abnormal operating conditions.

The present invention has been invented to overcome such disadvantages of the conventional latch needles.

OBJECT AND SUMMARY OF THE INVENTION

It is an object of the present invention to propose a latch needle for a Raschel machine, which can be easily arranged in alignment with a plurality of the latch needles at regular intervals and the dislocation of which in pouring a molten metal in the mold can be obviated.

The present invention provides a latch needle for a Raschel machine, having a branch stem branched from a portion of one side of the stem below the latch so as to extend downward substantially in parallel to the lateral side of the stem, and having a thickness greater than that of the stem.

According to the present invention, since the latch needle is provided with a branch stem branched from a portion of one side of the stem below the latch so as to extend downward substantially in parallel to the lateral side of the stem and having a thickness greater than that of the stem, a plurality of such latch needles can be easily arranged at regular intervals in the same situation with the hooks thereof in alignment with each other by the use of the branched stems thereof; the branch stems holds the latch needles in place while a molten metal is poured into a mold in which the stems of the latch needles are inserted to prevent the regular arrangement of the latch needles being disordered; and the latch needles are not bent or broken even when a large and sudden force is applied to the latch needles of the needle block, since the latch needles are reinforced by the branch stems, respectively.

DETAILED DESCRIPTION OF THE PREFERRED EMBODIMENTS

Figure 1:
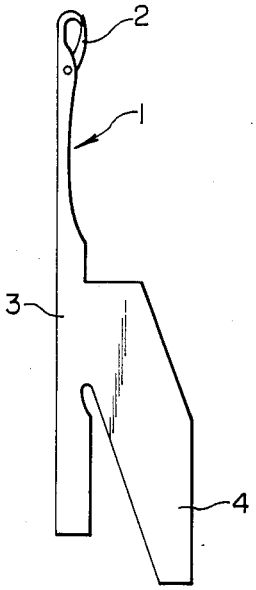
FIG. 1 is a side elevation of a latch needle, in a first embodiment, according to the present invention.

FIG. 1 is a side elevation of a latch needle, in a first embodiment, according to the present invention.

Referring to FIG. 1, a latch needle 1 is provided with a branch stem 4 branched from a portion of one side of the stem 3 thereof below the latch 2 so as to extend downward within a plane containing the lateral side of the stem 3.

Figure 2:
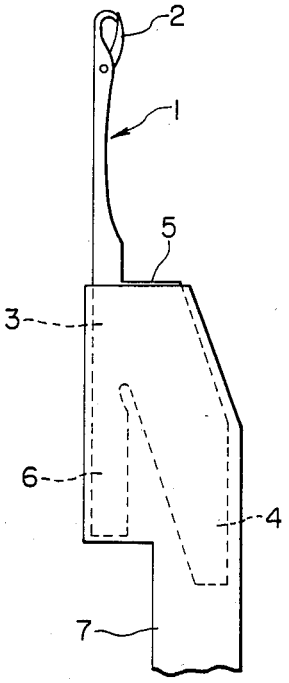
FIGS. 2 and 3 are side elevations of needle blocks fixedly holding latch needles according to the present invention, respectively.
Figure 3:
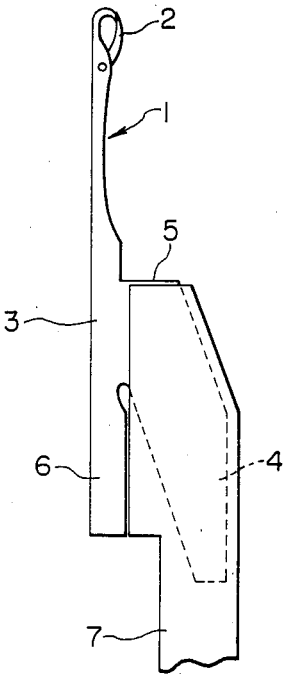
Figure 4:
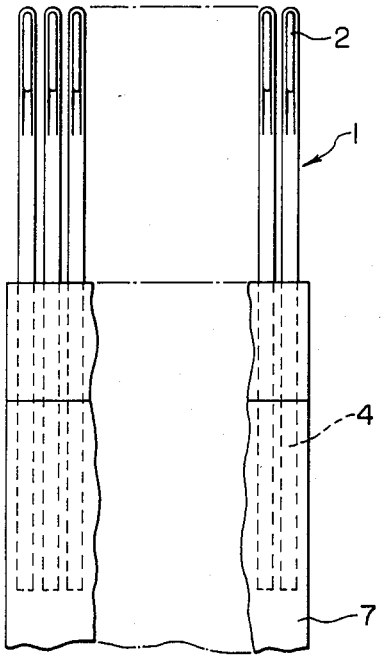
FIG. 4 is a front view of the needle blocks of FIGS. 2 and 3.

In manufacturing a needle block having a plurality of such latch needles 1, the latches are disposed on the same side by arranging the latch needles with the branch stems 4 arranged on the same side and the hooks of the latch needles 1 are arranged in alignment with each other by aligning the shoulders 5 of the branch stems 4 with the same straight line. The lower portions of the stems 3, the base portions 6 and the branch stems 4 of the latch needles 1 are located within a mold as illustrated in FIG. 2, and then a molten metal having a low melting point is poured into the mold to burry the lower portions of the stems 3, the base portions 6 and the branch stems 4 of the latch needles 1 in a metal block 7 to form a needle block. Most Raschel machines are fitted with sinkers, namely, knitting elements of a Raschel machine, interposed between the adjacent latch needles, respectively. Accordingly, it is usual to burry only the branch stems 4 of the latch needles 1 in the metal block 7 as shown in FIG. 3, to form a needle block as shown in FIG. 4.

The latch needle in a first embodiment shown in FIG. 1 has the branch stem 4 branched from the stem 3 so as to form an inverted V-shaped part. In a second embodiment, a branch stem 4 is branched from a stem 3 so as to form an inverted U-shaped part in a latch needle 1. Naturally, a branch stem 4 may be formed in any other suitable shape.

Figure 6:
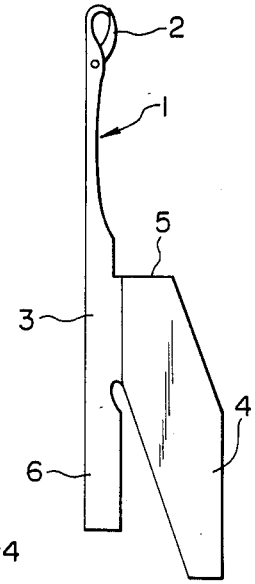
FIG. 6 is a side elevation of a latch needle in a third embodiment, according to the present invention.

The branch stem 4 of the latch needle 1 in a first embodiment shown in FIG. 1 facilitates disposing such a latch needle 1 in correct situation, positioning the hook of such a latch needle 1 and arranging a plurality of such latch needles 1 at regular intervals. A study was made to improve the latch needle further to facilitage closely arranging latch needles at regular intervals and further to ensure the prevention of dislocation of the latch needles in pouring a molten metal in the mold to form a needle block. The objects of the study was fully achieved by a branch stem 4 having a thickness greater than that of the stem 3 and the base portion 6 of a latch needle 1. FIG. 6 illustrates such in improved latch needle 1 in a third embodiment.

Figure 7:
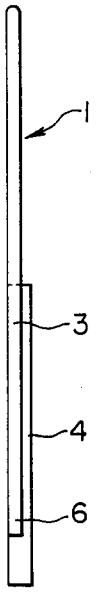
FIG. 7 is a rear elevation of the latch needle of FIG. 6.
Figure 8:
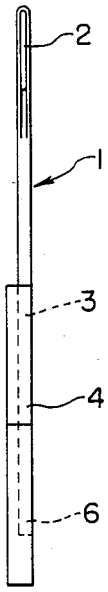
FIG. 8 is a front elevation of the latch needle of FIG. 6.
Figure 9:
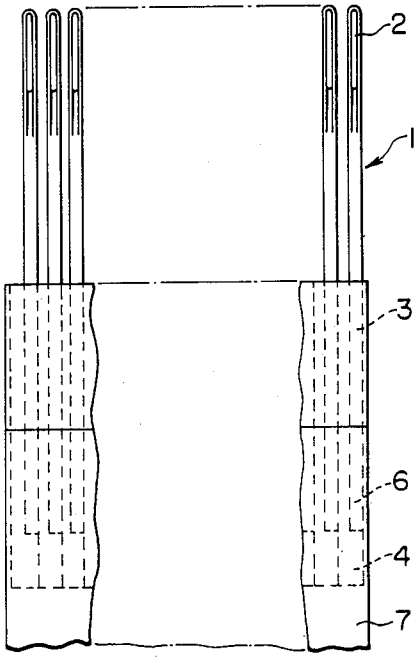
FIG. 9 is a front elevation of a needle block fixedly holding a plurality of the latch needles of FIG. 6.

The latch needle 1 shown in FIG. 6 has a branch stem 4 having a thickness greater than that of the stem 3 and the base portion 6 of the latch needle 1. One lateral side of the branch stem 4 is protruded from a plane of the corresponding lateral side of the stem 3 as illustrated in FIGS. 7 and 8. It is preferable that the increment of the thickness of the branch stem 4, namely, the distance of protrusion of the lateral side of the branch stem 4 from the plane of the corresponding lateral side of the stem 3, corresponds to the distance between the adjacent latch needles 1 when a plurality of the latch needles 1 are arranged. In manufacturing a needle block having a plurality of the latch needles at regular intervals, the latches 2 are arranged on the same side by arranging the branch stem 4 on the same side, the hooks of the latch needles 1 are aligned with a straight line by aligning the shoulder 5 of the branch stems 4 with each other, and the latch needles 1 are arranged at regular intervals by arranging the branch stems 4 contiguously as shown in FIG. 9. After the latch needles 1 have been thus arranged, all the latch needles are burried in a metal block of a metal having a low melting point to form a needle block as shown in FIG. 9.

Thus, the branch stem 4 facilitates uniformly arranging the latch needles and aligning the hooks of the latch needles and, since the increment of the thickness of the branch stem 4 relative to the thickness of the base portion 6 and the stem 3 of the latch needle determined the interval between the adjacent latch needles. Accordingly, a plurality of the latch needles are arranged regularly simply by placing the latch needles with the lateral sides of the branch stems 4 of the adjacent latch needles in abutment with each other and the dislocation of the latch needles in pouring a molten metal in the mold can be obviated.

Figure 10:
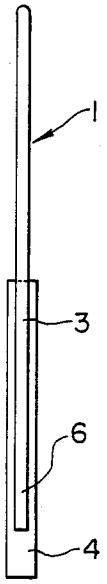
FIG. 10 is a rear elevation of a latch needle, in a fourth embodiment, according to the present invention.
Figure 11:
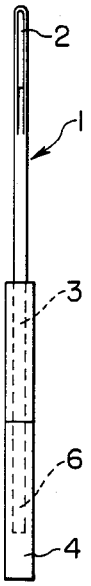
FIG. 11 is a front elevation of the latch needle of FIG. 10.
Figure 12:
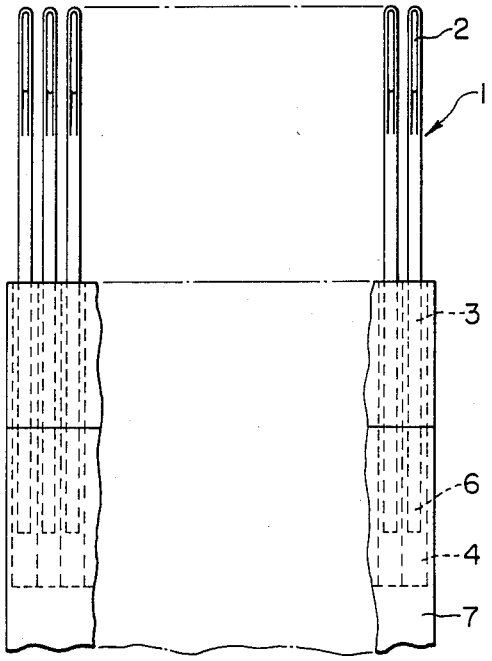
FIG. 12 is a front elevation of a needle block fixedly holding a plurality of the latch needles of FIG. 10.

FIGS. 10 to 12 illustrate a latch needle 1 in a fourth embodiment. The latch needle 1 is provided with a branch stem 4 having a thickness greater than that of the stem 3 and the base portion 6 thereof. Both of the lateral sides of the branch stem 4 are protruded equally from planes of the corresponding lateral sides of the stem 3, respectively each by an increment of thickness relative to the thickness of the stem 3 and the base portion 6 corresponding to the half of the distance between the opposite lateral sides of the adjacent latch needles 1. When a plurality of the latch needles 1 are arranged with the branch stems of the adjacent latch needles in abutment with each other, the latch needles 1 are arranged, similarly to those in the third embodiment, at regular intervals. Thus, a needle block having a plurality of the latch needles 1, as shown in FIG. 12, can be formed simply and quickly.

Figure 13:
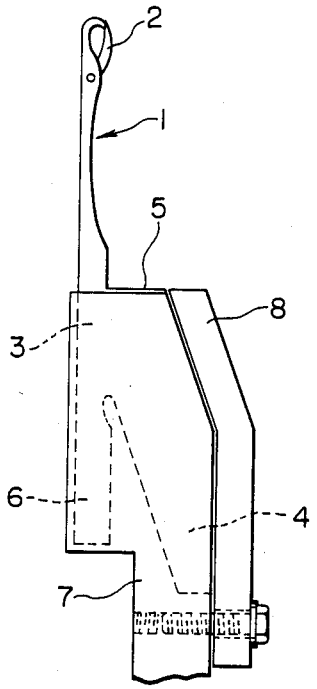
FIG. 13 is a side elevation of a needle block fixedly holding the latch needle according to the present invention, in a modified form.

As apparent from the foregoing description, a needle block provided with a plurality of the latch needles arranged at desired regular intervals can be formed by arranging the latch needles each having a branch stem having an appropriate increment of thickness relative to the thickness of the stem and the base portion thereof, corresponding to the desired regular intervals. When latch needles provided with very thick branch stems, respectively, are arranged with the adjacent branch stems in abutment with each other in forming a needle block, there is fear that the latch needles are not held firmly by the metal block, because the metal is unable to flow between the adjacent branch stems. Therefore, rough surfaces or fine grooves may be formed in the lateral sides of the branch stem or small holes may be formed in the branch stem to enhance the fastening effect of the molten metal, or a fastening block 8 may be fastened to the front side of the needle block with bolts 9 as shown in FIG. 13 further to ensure the fixation of the latch needles 1 to the metal block.

Figure 5:
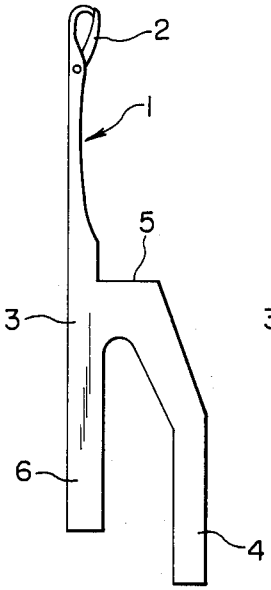
FIG. 5 is a side elevation of a latch needle, in a secood embodiment, according to the present invention.

Furthermore, the formation of the latch needles in the third and fourth embodiments may be a form as shown in FIG. 5 or any other form, provided that the thickness of the branch stems thereof is greater than that of the stem and the base portion thereof.

As apparent from the foregoing description, the latch needle according to the present invention is provided with a branch stem branched from a portion of one side of the stem below the latch so as to extend downward substantially in parallel to the lateral side of the stem and having a thickness greater than that of the stem and the base portion of the latch needle. Accordingly, in manufacturing a needle block by arranging a plurality of the latch needles at regular intervals and burrying the branch stems in a metal block formed by pouring a molten metal in a mold, the situation of the latches of the latch needles can be simply and correctly decided by arranging the branch stems on the same side, the hooks of the latch needles can be aligned by aligning the shoulders of the branch stems, and the latch needles can be easily arranged at regular intervals by holding the latch needles at the respective branch stems extending from the stems. Particularly, the branch stems having a thickness greater than that of the stem enables quick arrangement of the latch needles at regular intervals by arranging the latch needles with the latch needles with the adjacent branch stems in abutment with each other.

Furthermore, the conventional latch needle is held in a needle block only at the stem, whereas the latch needle according to the present invention is held firmly in a needle block at the branch stem. Therefore, the latch needle according to the present invention withstands a stress existing therein because of strain by a large and impulsive external force applied thereto during the operation of the Raschel machine and is neither bent nor broken on the needle block.

What is claimed is:

1. A latch needle, having a branch stem branched from a portion of one side of the stem below the latch so as to extend downward substantially in parallel to the lateral side of the stem.

2. A latch needle according to claim 1, wherein a shoulder of the branch stem is formed of the upper end thereof at a predetermined distance from the hook of the latch needle.

3. A latch needle according to claim 1, wherein said branch stem is formed integrally with the stem and extends downward within a plane containing the lateral side of the stem.

4. A latch needle according to claim 1, wherein the thickness of said branch stem is greater than that of the stem.

5. A latch needle according to claim 4, wherein one lateral side of said branch stem is protruded from the lateral side of the stem.

6. A latch needle according to claim 4, wherein each of the lateral sides of said branch stem is protruded equally from the corresponding lateral sides of the stem, respectively.

7. A needle block comprising a plurality of latch needles having branch stems branched from a portion of one side of the stem below the latch so as to extend downward substantially in parallel to the lateral side of the stem, and a metal block in which the branch stems are burried and fixed by a molten metal so that the latches are disposed on the same side and are arranged in alignment with each other.

* * * * *

UNITED STATES PATENT OFFICE

CERTIFICATE OF CORRECTION

Patent No. 4,665,717 Dated May 19,1987

Inventor(s) Atsushi KUROKAWA

It is certified that error appears in the above-identified patent and that said Letters Patent are hereby corrected as shown below:

Change the name of the inventor from"Kurokawa Atsushi"

to ----- Atsushi Kurokawa---.

Signed and Sealed this

Thirteenth Day of October, 1987

*Attest:*

DONALD J. QUIGG

*Attesting Officer*

*Commissioner of Patents and Trademarks*